United States Patent [19]

Silcox

[11] 4,095,421

[45] Jun. 20, 1978

[54] SUBSEA ENERGY POWER SUPPLY

[75] Inventor: William H. Silcox, San Francisco, Calif.

[73] Assignee: Chevron Research Company, San Francisco, Calif.

[21] Appl. No.: 652,447

[22] Filed: Jan. 26, 1976

[51] Int. Cl.[2] ..... E21B 29/00; F01K 27/00

[52] U.S. Cl. ..... 60/398; 60/404; 137/81; 137/236 S; 166/0.5; 251/1 R; 251/130; 251/131

[58] Field of Search ..... 166/53; 137/81, 236; 251/1 R, 1 A, 1 B; 60/398; 114/257; 61/0.5, 101

[56] References Cited

U.S. PATENT DOCUMENTS

| | | | |
|---|---|---|---|
| 2,664,096 | 12/1953 | Murdock et al. | 137/282 X |
| 3,163,985 | 1/1965 | Bouyoucos | 137/81 X |
| 3,205,969 | 9/1965 | Clark | 60/398 X |
| 3,319,923 | 5/1967 | Haeber et al. | 251/1 A |
| 3,436,914 | 4/1969 | Rosfelder | 60/398 |
| 3,447,552 | 6/1969 | Grosson | 137/81 |
| 3,766,978 | 10/1973 | Orund et al. | 166/0.5 |
| 3,943,972 | 3/1976 | Bitonti et al. | 137/596.17 X |

*Primary Examiner*—Martin P. Schwadron
*Assistant Examiner*—Richard Gerard
*Attorney, Agent, or Firm*—Ralph L. Freeland, Jr.; Edward J. Keeling; William J. Egan, III

[57] ABSTRACT

A negative energy power supply which operates submerged equipment like a hydraulic actuator. A main component of the system is a submerged chamber held at substantially atmospheric pressure. It is connected to submerged equipment having intake and discharge ports controllable by remotely operated valves. When the intake port is opened to water at the submerged depth of the equipment and the discharge port is vented to the chamber, the resulting pressure difference operates the submerged equipment. The system can also have appropriately connected to it, a pressure amplifier to increase the water pressure at a submerged location and a pump to purge the chamber.

23 Claims, 10 Drawing Figures

SUBSEA ENERGY POWER SUPPLY

BACKGROUND OF THE INVENTION

1. Field of the Invention

This invention relates to a primary or secondary (backup) system for actuating a submerged hydraulic system. Specifically, the invention pertains to a primary system for actuating submerged fluid-actuable equipment. Also it pertains to a secondary power system to backup a primary one that has temporarily failed so that the fluid actuatable equipment is still operatable.

2. Prior Art

Subsea systems (powered by electric, hydraulic or pneumatic power) can be used for many purposes. They may, for example, control subsea tank valves or subsea wellheads.

By way of example, we will explain the use of this invention with a "blowout preventer (BOP) stack" used in drilling wells on the ocean floor. The BOP provides means for closing a well head either fully or around a drill pipe to contain well pressure or circulate, condition and return fluids to and from a subsea oil well so as to maintain well pressure control. On occasion its primary power system may fail to provide power to operate the BOP stack.

The current procedure used in case of such a failure utilizes a diver-connected power source instead of devices that are actuated by apparatus which utilize the ambient pressure in which the system is submerged. This procedure is time-consuming, and at depths over several hundred feet may be impossible to accomplish without a submarine vessel. One alternate approach, which is likewise time-consuming, is to lower an energizing hydraulic spear (attached to hydraulic lines) down into a receptacle on the BOP stack. The receptacle is hydraulically connected to actuators that operate selected functions of the BOP stack. If this is not possible, control of the subsea system may be lost or at least required to be temporarily abandoned.

Noteworthy is that failure of the source of power becomes less probable when the method and apparatus of this invention is used as the primary power source. The reason is that it does not rely entirely on the operation of a hydraulically or electrically powered system. Further, the negative energy supply system is a quick-response one, since it is located adjacent to the equipment it operates. Contrasted to this is a hydraulic system which has a source of fluid located at the water surface such as on a drilling platform. The response of such a system to operate deeply submerged equipment is considerably slower than the present invention because of the long distance the fluid must travel.

BRIEF SUMMARY OF THE INVENTION

The main component of the present embodiment of my invention is a pressure vessel, receiver or chamber sealed to hold atmospheric pressure. Alternatively, it may be adapted to be vented above the water surface in a manner which allows atmospheric pressure to be maintained in the submerged receiver. It can then be connected to a subsea actuator. In turn, the actuator's intake and discharge ports are connected respectively to remotely operated valves that control the flow of fluid to and from the discharge ports so as to operate equipment that is necessary to control a wellhead. More specifically, the valves expose the actuator's intake ports to the sea and vent its discharge ports to the chamber at atmospheric pressure.

The present invention can be utilized to appropriately open the intake port of the actuator to the sea, while simultaneously venting its discharge port to the receiver. A pressure difference (resulting from the hydrostatic pressure at the subsea location of the intake port and the substantially atmospheric pressure of the chamber at the discharge port) operates the actuator. This pressure difference within the actuator is then adaptable to close valves, start and stop pumps or other subsea equipment that needs a force to operate it.

In shallow waters, a pressure amplifier can be provided to increase the available water pressure to supply the pressure differential needed to operate the actuator. Further, means can be provided to purge the vented pressure vessel once it receives a charge of the fluid that operates the actuator.

Besides these aspects and advantages of the invention, other ones will become apparent from the drawings, description of the preferred embodiment, and the claims.

DESCRIPTION OF THE PREFERRED EMBODIMENT

The subsea negative energy power supply may be a primary, auxiliary or backup system for operating a hydraulically actuable device, such as subsea actuator 106, FIGS. 2–10. A pair of actuators 106 can operate the rams of the BOP stack (FIG. 1) that are pneumatically, hydraulically or electrically actuable as explained below. This stack customarily includes a series of vertically interconnected BOP's of different types which are operated independently of each other to control well fluids in the event the well pressure exceeds the drilling fluid head.

Figure 1:
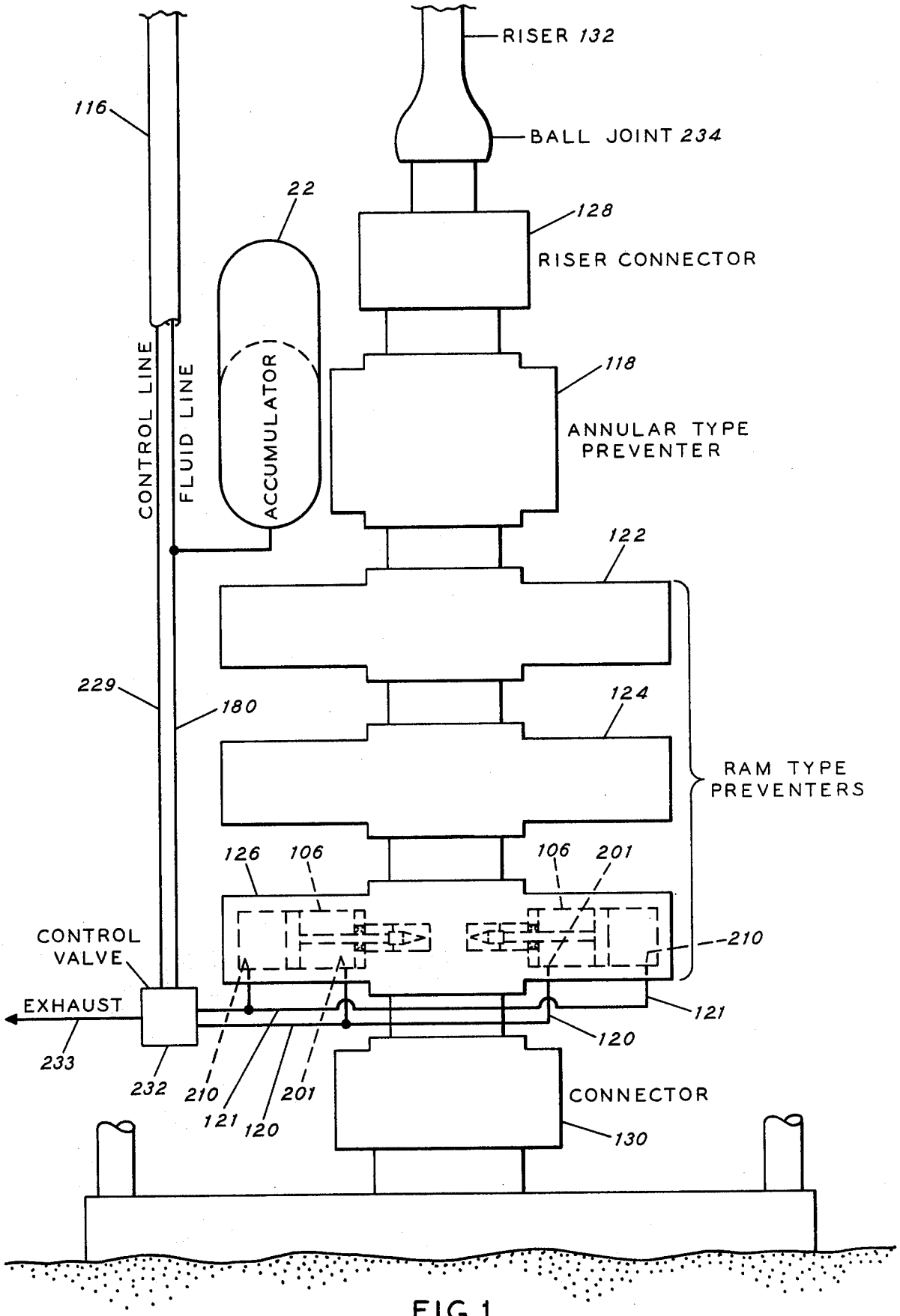
FIG. 1 is a schematic illustration of one specific embodiment of the apparatus that can be controlled with the present invention. This figure shows a side elevation of a subsea blowout prevention equipment used to control drilling operations of a subsea well head system from a floating platform. The present invention is connectable to operate the blowout equipment.
Figure 2:
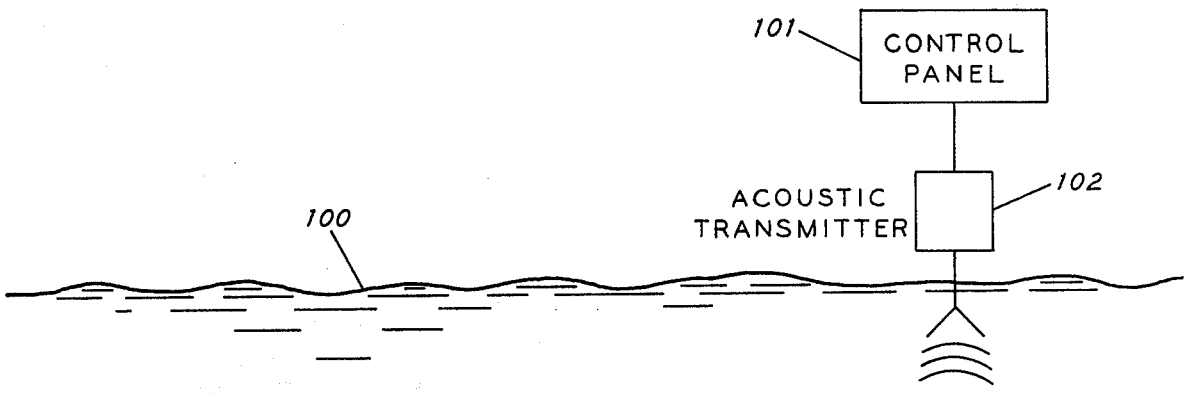
FIG. 2 is a schematic illustration of one form of apparatus suitable for carrying out the present invention which includes a subsea receiver sealed at atmospheric pressure or at a vacuum. This is the arrangement the apparatus of the invention is in prior to actuation.
Figure 2:
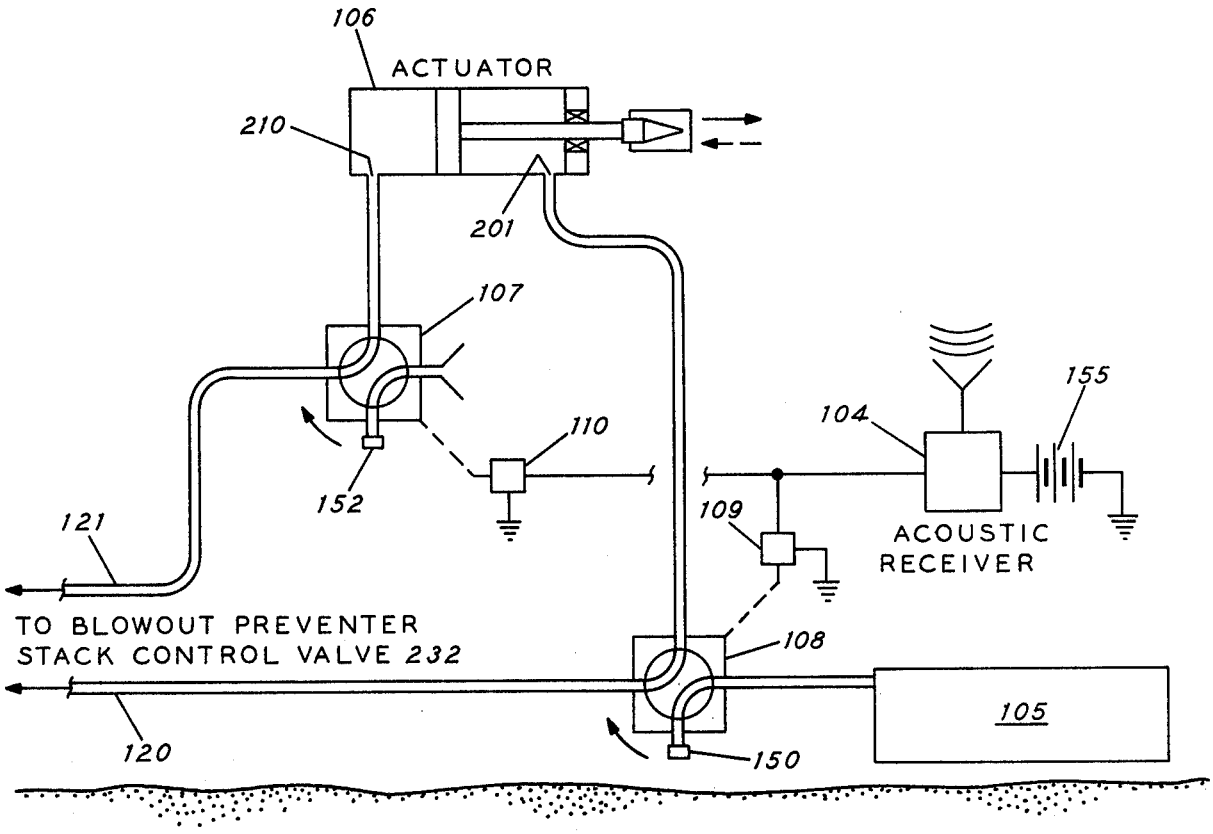
Figure 3:
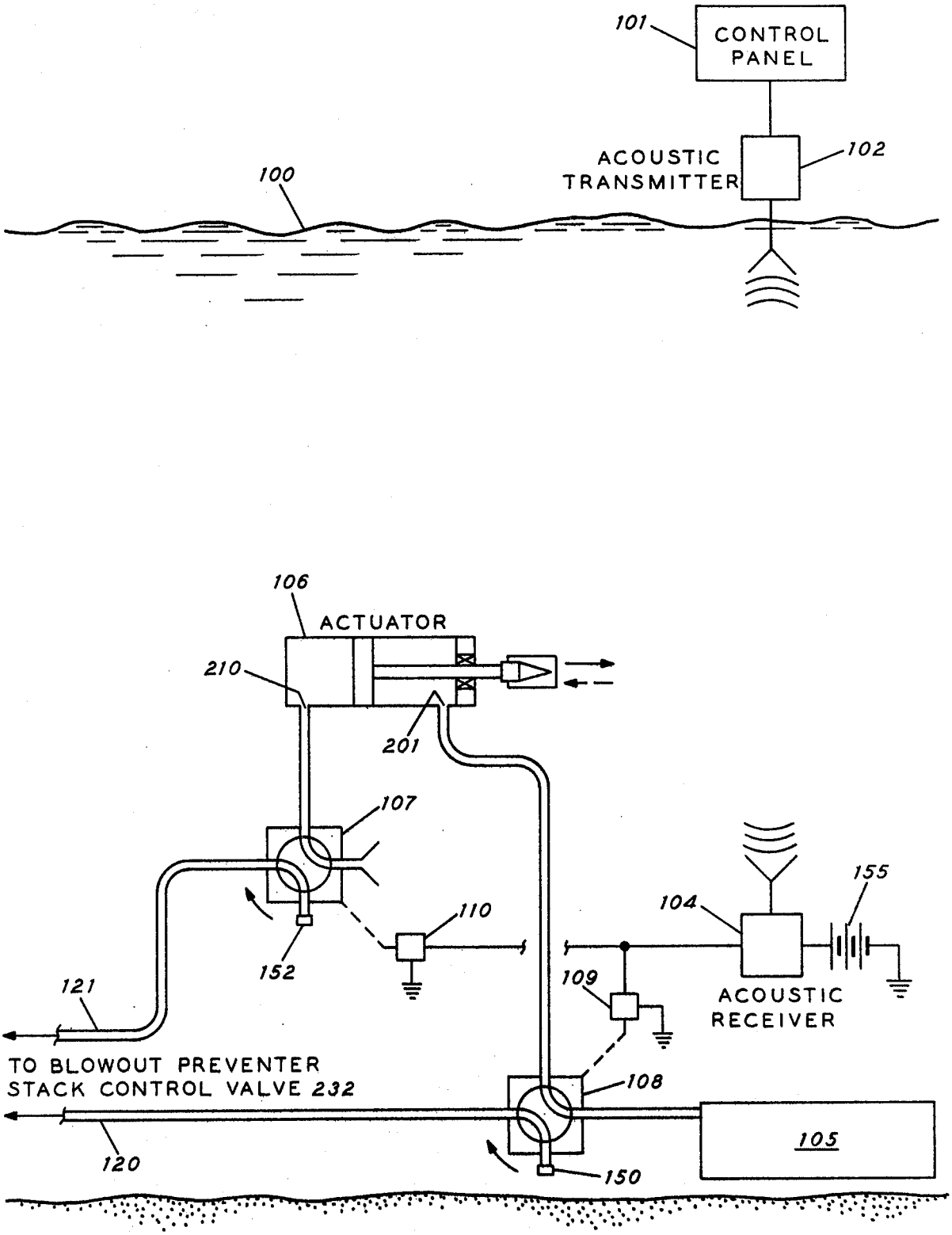
FIG. 3 is a schematic illustration of the present invention showing the actuator vented to the receiver at a predetermined pressure. This is the arrangement the invention takes when it is activated.

In the apparatus illustrated in FIG. 1, numeral 118 represents a bag-type BOP (fits around a drill pipe including drill collars). The numerals 122, 124 and 126 designate ram-type BOP's (blocks the drilling hole or fits only around a drill pipe). Numerals 128 and 130 represent a hydraulically powered marine riser and well head connectors. Connector 128 is connected to marine riser 132 below ball joint 234 and detachably connected to the top of the BOP stack; connector 130 is detachably connected to the well casing head.

Also of significance is the hydraulic or pneumatic control system for such a blowout preventer stack. The hydraulic or pneumatic fluid (controlled at the surface) generally flows through hoses that are fabricated into bundle 116. This flow path is in series with accumulator 22 -- the subsea storage space for hydraulic or pneumatic fluid power generated by equipment located above the water surface. Consequently, subsea connectors 128, 130, preventers 118, 122, 124, 126, are controllable from a water surface location. Nevertheless, a person skilled in the art will appreciate that not all of these devices are needed to practice the method of the present invention in every situation.

As stated before, it is desirable that at least the BOP's operate independently of each other. To accomplish this in normal operation, hydraulic fluid from a pressure source at the ocean surface is stored under pressure in accumulator 22, FIG. 1. Pressurized hydraulic fluid is conducted to valve 232 through hydraulic line 180. This valve is controlled from the surface by hydraulic, pneumatic or electrical signals through control line 229. Depending upon the function to be performed by actuator 106, hydraulic fluid passes through the control valve through either line 120 or 121. Similarly, exhaust fluid will be discharged from actuator 106 through either line 121 or 120 to control valve 232 which is vented through port 233. The apparatus of the present invention, to repeat, may be used to provide a back-up system to the primary control system described above. Typical illustrations are shown in FIGS. 2–9 where the water surface is indicated by numeral 100.

In FIGS. 2–9, the actuator is shown in a subsea position connected to a first valve means, control valve 107 with plugged outlet 152. This valve isolates the energizing side 210 of actuator 106 from communication with the source of pressurized hydraulic fluid, (see FIGS. 2 and 3). Simultaneously, it places the energizing side of actuator 106 in communication with the water at the depth of the submerged location. A second valve means, control valve 108 with plugged outlet 150, is located at the discharging or exhaust side 201 of actuator 106. This valve isolates the discharge of actuator 106 from the BOP control system while simultaneously placing the discharging side of the actuator in communication with the receiver 105.

Thus, valve 108 is normally closed to the receiver or chamber 105 whose interior is at a predetermined pressure (that is a pressure less than that found exterior to receiver 105). And valve 107 is normally closed to the hydrostatic head provided by the depth of the water it is in. If power that usually operates the valves fails, valves 107 and 108 can be constructed and arranged to be actuated from a location remote therefrom.

For instance, an acoustic transmitter 102 located, e.g. on an offshore platform at the surface of a body of water, initiates or generates a sonic signal through the water to acoustic receiver 104 located adjacent to the subsea bottom. It converts the sonic signal to an electric pulse. This pulse closes relays 109 and 110 so as to allow storage battery 155 or other power sources such as another accumulator or another system using the present invention to actuate respectively valves 107 and 108, positioned near the submerged location. As a result, normal BOP control piping 120 and 121 — hydraulically in series with, for example, control valves for the BOP's — is disconnected from the energizing or opening side, 210, FIG. 3 of actuator 106 and exposed to the water or hydrostatic pressure at the depth of the location of the actuator. At the same time, the discharging side, 201, of actuator 106 is hydraulically connected to receiver 105. Consequently, the difference in hydrostatic pressure at the depth of the location and the pressure of receiver 105 is made available to actuate actuator 106 which discharges hydraulic fluid through discharge port 201 into receiver 105, FIG. 3.

Figure 4:
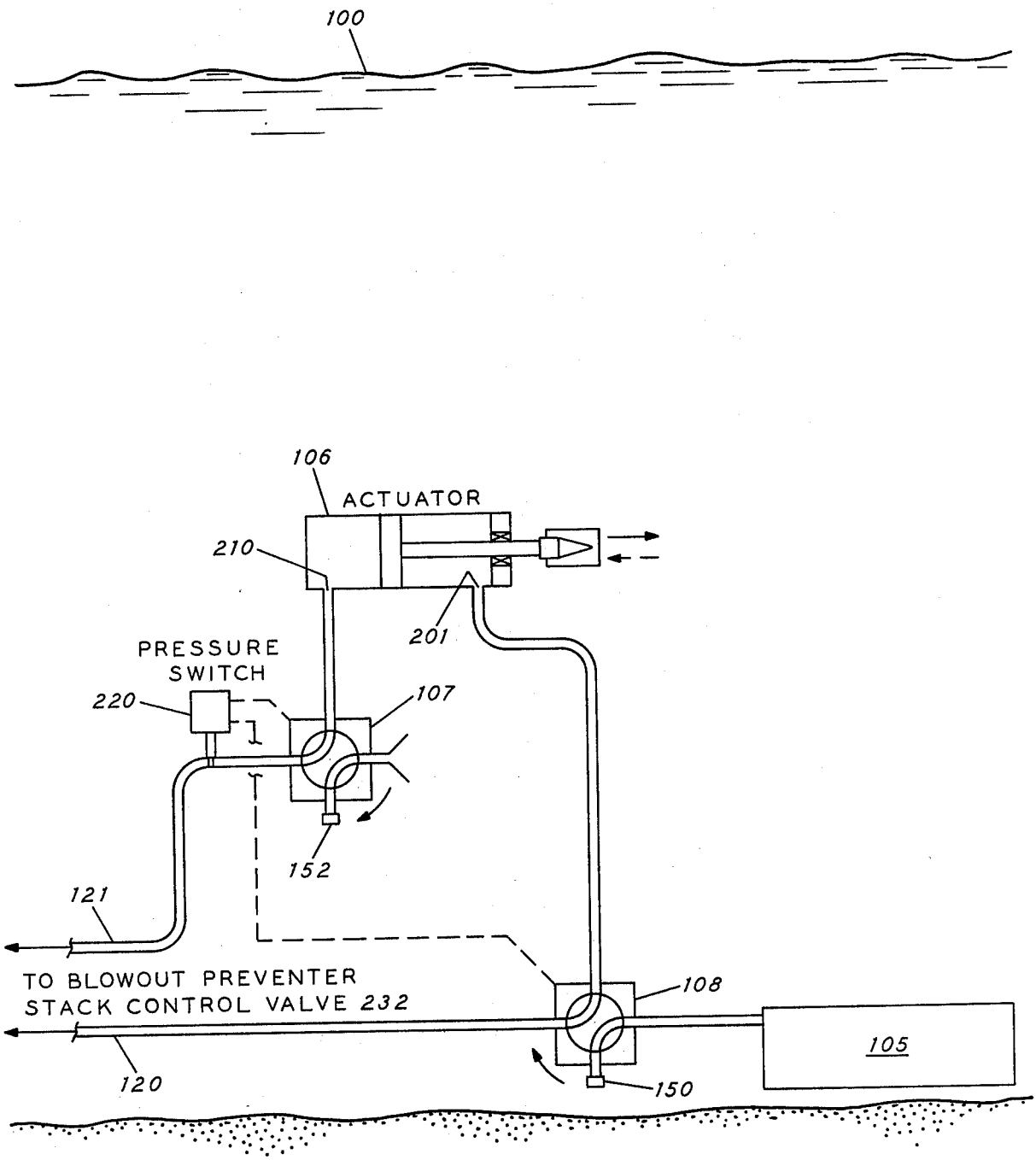
FIG. 4 is a schematic illustration of present invention having a pressure switch to control the actuator instead of the sonic receiver/transmitter of FIG. 1.

Alternatively, this sequence can be set off by pressure switch 220, with a self-contained power source, connected to the control piping, FIG. 4. When it senses a pressure change beyond a predetermined range, valves 107 and 108 are triggered by it from their normal position to operate the actuator as above.

Figure 5:
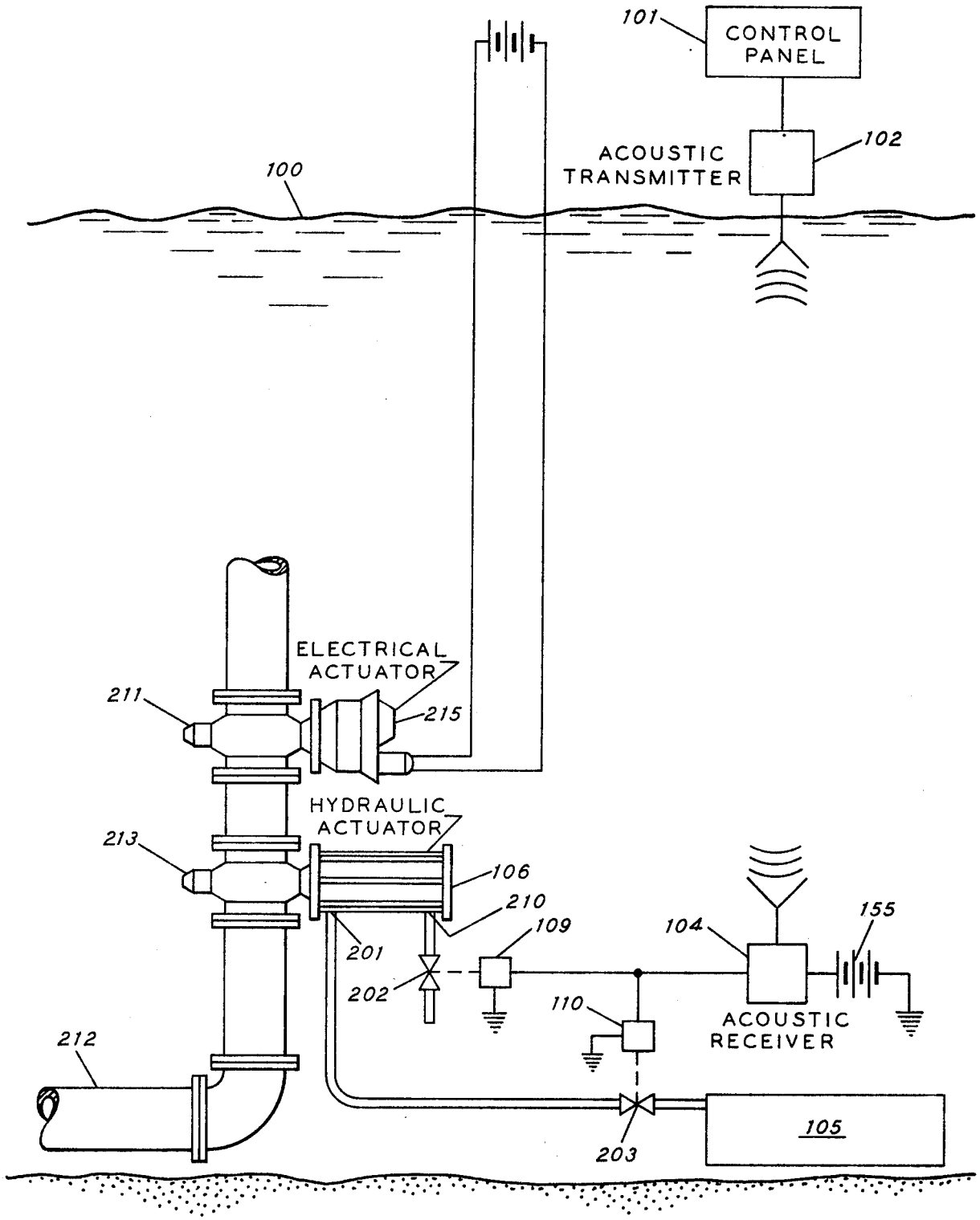
FIG. 5 is a schematic illustration of another embodiment of this invention. This figure illustrates a backup system for operating an electrically powered device submerged in a body of water.
Figure 6:
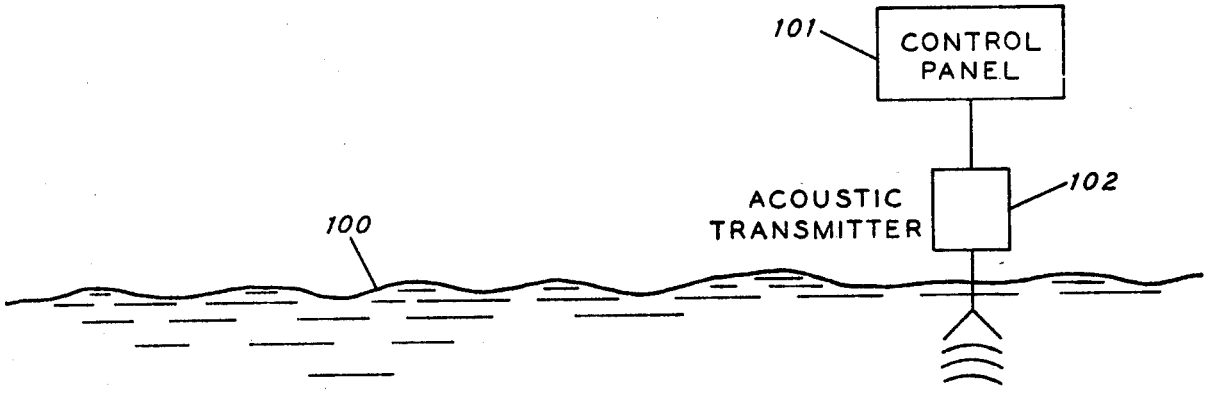
FIG. 6 is a schematic illustration of the present invention of FIG. 2 with a pressure amplifier to amplify the operating pressure resulting from the hydrostatic pressure at the subsea location of the invention.
Figure 6:
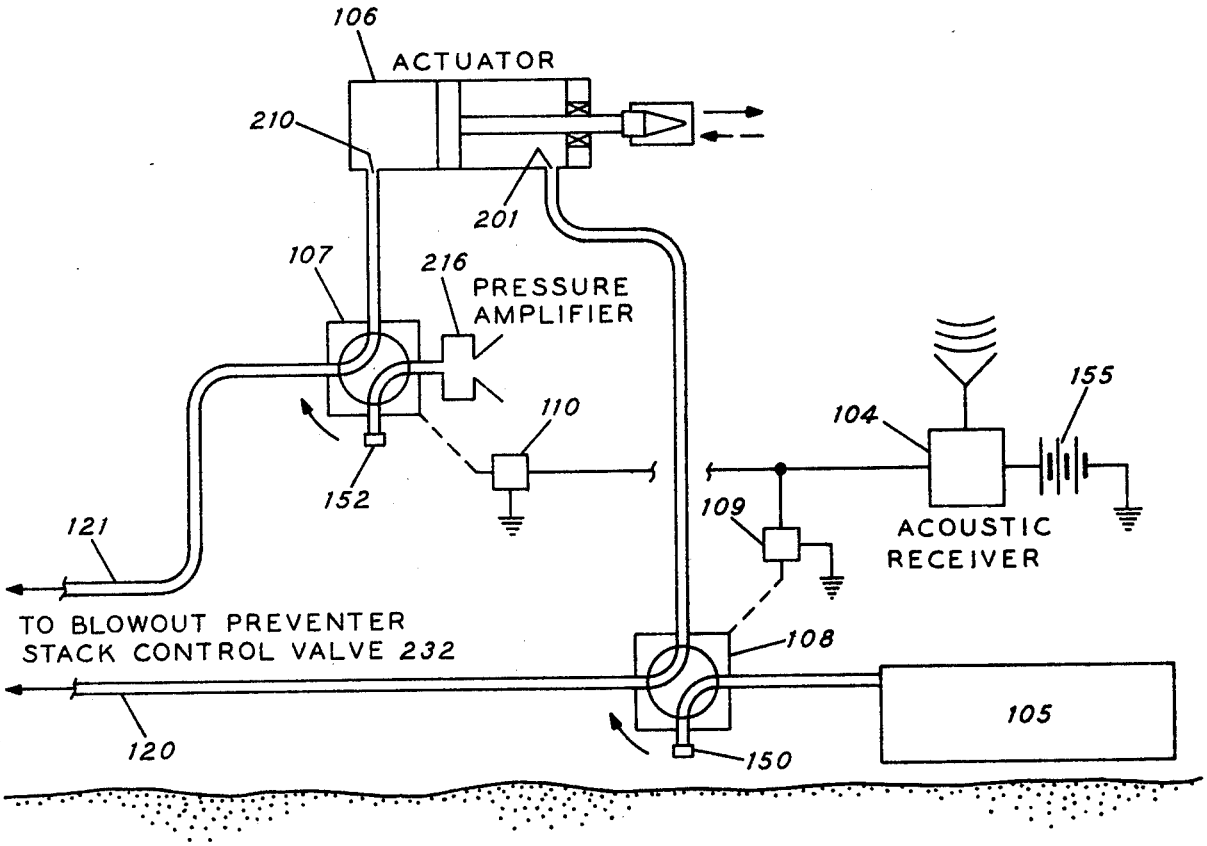

In the case of a back up system for operating an electrically powered system submerged in a body of water, FIG. 5, the actuator 106 is connected to the electrically powered system so that it is operable by the actuator. For example in FIG. 5, the system comprises valve 211, a fail open valve, which is ordinarily opened and closed by electric actuator 215. This valve controls the flow through a subsea pipeline 212. A way to make the system operable by the actuator 106 is to provide a supplementary hydraulic circuit that has actuator 106 connected to a second control valve 213 located adjacent to the valve 211. A first two-way valve 202 is connected to the energizing side 210 of actuator 106, and a second two-way valve 203 is connected between the discharging side 201 of the actuator and receiver 105. This receiver has a predetermined gaseous pressure within it.

Valve 202 is a means for exposing the energizing side of the actuator to the hydrostatic pressure at its submerged location. Valve 203 is a means for communicating the discharging side of the actuator with the receiver. Valves 202 and 203 are operated simultaneously by the acoustic receiver 104 through relays 109 and 110 when a signal is received from the surface acoustic transmitter 102. This arrangement allows the resulting pressure difference between the internal pressure of the receiver and the hydrostatic pressure at the depth the actuator is at to operate the actuator and equipment connected to it. This occurs as water flows from the body of water into the energizing side of the actuator and fluid is pushed out the discharge side of the actuator into the receiver.

Other apparatus can be added into the system so that the system is readily adaptable to its environment. For instance, a water depth amplifier or pressure amplifier 216, FIG. 6 can be connected to the closing side of actuator 106. The water depth or pressure amplifier increases the operating pressure at the water depth of the submerged location when the hydrostatic pressure is insufficient to actuate actuator device 106. In other words, an amplifier can be provided to increase the operating pressure at the water depth of actuator 106 when this depth does not provide enough of a pressure difference between the hydrostatic pressure and the internal pressure in the submerged receiver to actuate this actuator.

The description now turns to receiver 105, FIGS. 2–10, also referred to as a chamber, pressure vessel, tank or receptacle. It is at a predetermined pressure, as already mentioned, which may be substantially atmospheric pressure (FIGS. 2–6, 9); vented to the atmosphere, FIGS. 7, 8 and 10); or sealed at a vacuum (FIGS. 2–6 and 9). Thus, receiver 105 is a means for containing an internal pressure less than the fluid pressure exerted on the submerged equipment.

The location of receiver 105 is such that the accompanying pressure drop associated with piping as well as miscellaneous entrance and exit pressure losses through the valves does not reduce the hydrostatic head below the amount needed to adequately operate a given piece of subsea equipment. Two examples are given to illustrate this.

First take the case of subsea equipment, located at 40 feet below sea level which requires little pressure to operate, say 2 psi, while tank 105 is located 10 feet below the water surface. If the over-all pressure drop leaves sufficient pressure difference to operate the equipment, the location and the pressure within the receiver is satisfactory. On the other hand, if the equipment requires a great deal of pressure (say 1500 psi), and it is located at water bottom (say 3000 feet below sea level) while the receiver with an internal pressure at atmospheric pressure is at the water surface, the result is an insufficient pressure differential to operate the equipment. This, however, is not the case if the receiver is located near the water bottom.

In brief, the only condition on both location and pressure of the receiver is that they result in enough of a pressure difference between the pressure in it and the hydrostatic head to operate the subsea equipment. Of course, I imply that appropriate accounting is taken for miscellaneous losses through any pipes, valves or the like.

Figure 7:
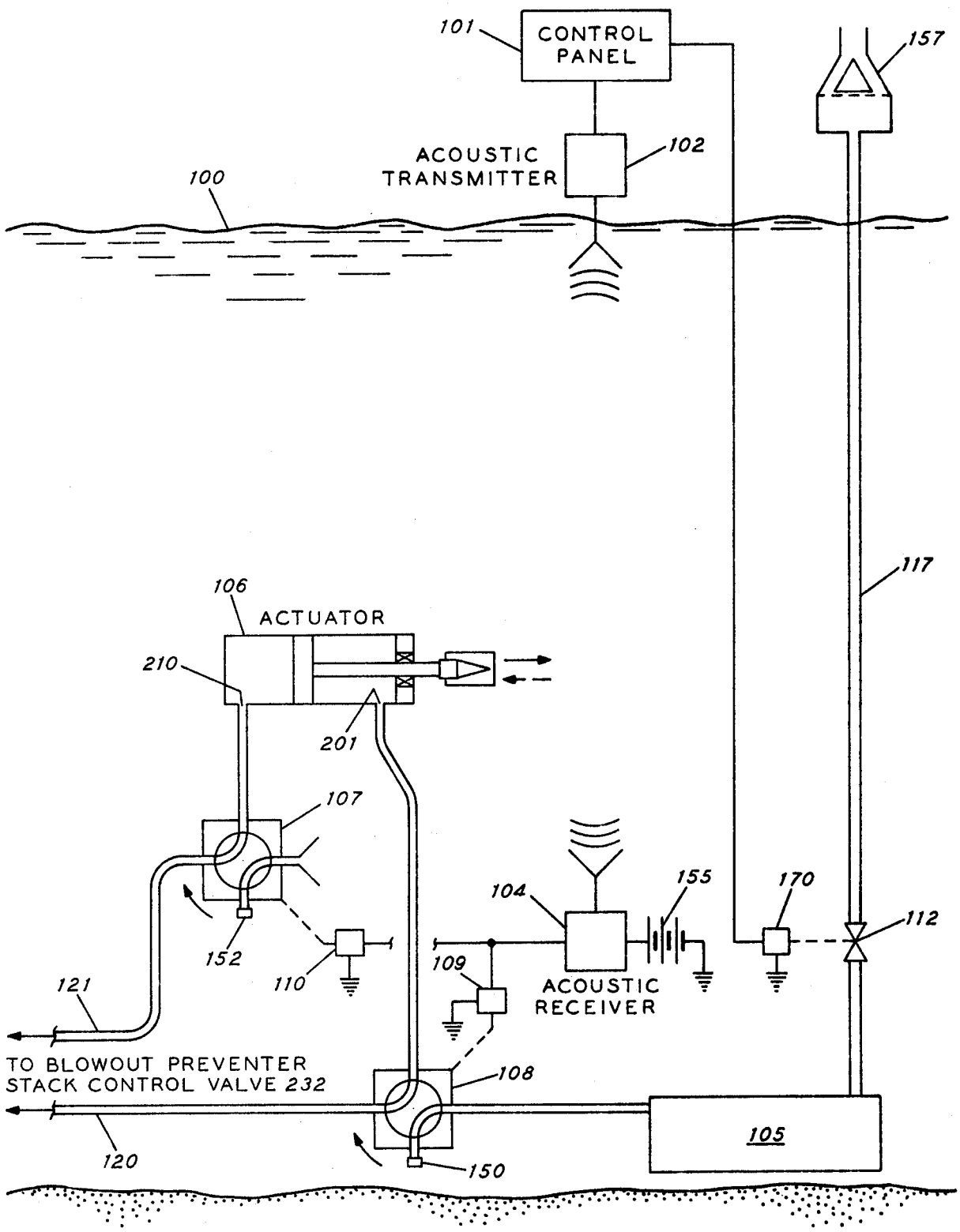
FIG. 7 is a schematic illustration of another embodiment of the present invention in which a subsea receiver is vented to the atmosphere.

When vent stack 117 is used to influence the pressure in the receiver, FIG. 7, the stack can be connected to control valve 112, which may be located at any point along the length of the vent. The valve is interconnected with the control panel through relay 170 so that it will automatically open when power is no longer received from panel 101. Further, float valving 157, FIG. 7, may be provided to prevent liquid from leaving the stack when it is not desirable to mix the hydraulic fluid with the surrounding sea after a hydraulic discharge has been received in receiver 105 and it becomes emminent the discharge may over flow.

Figure 8:
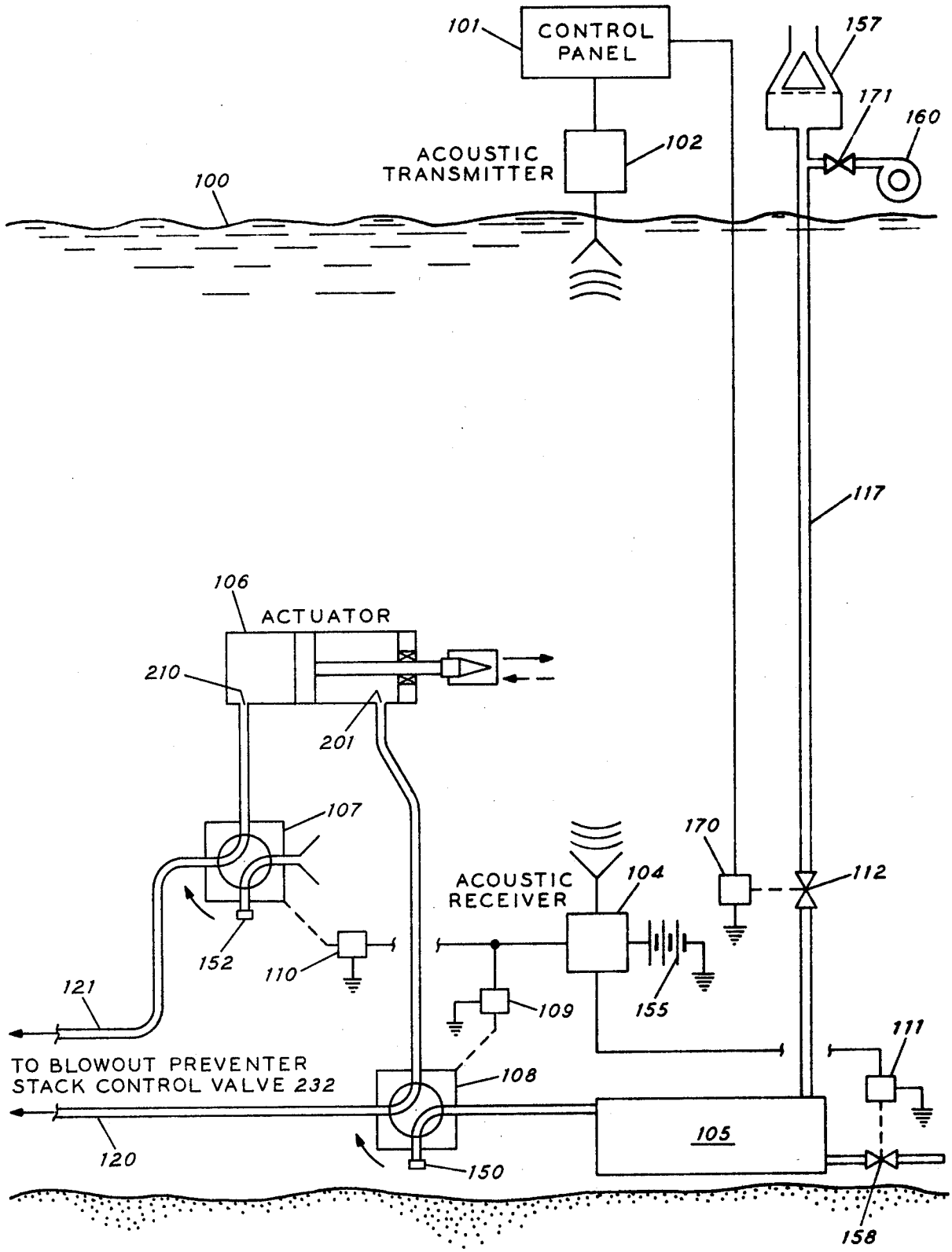
FIG. 8 is a schematic illustration of the present invention of FIG. 7 which is arranged so the subsea receiver may be blown out by using a vent.
Figure 10:
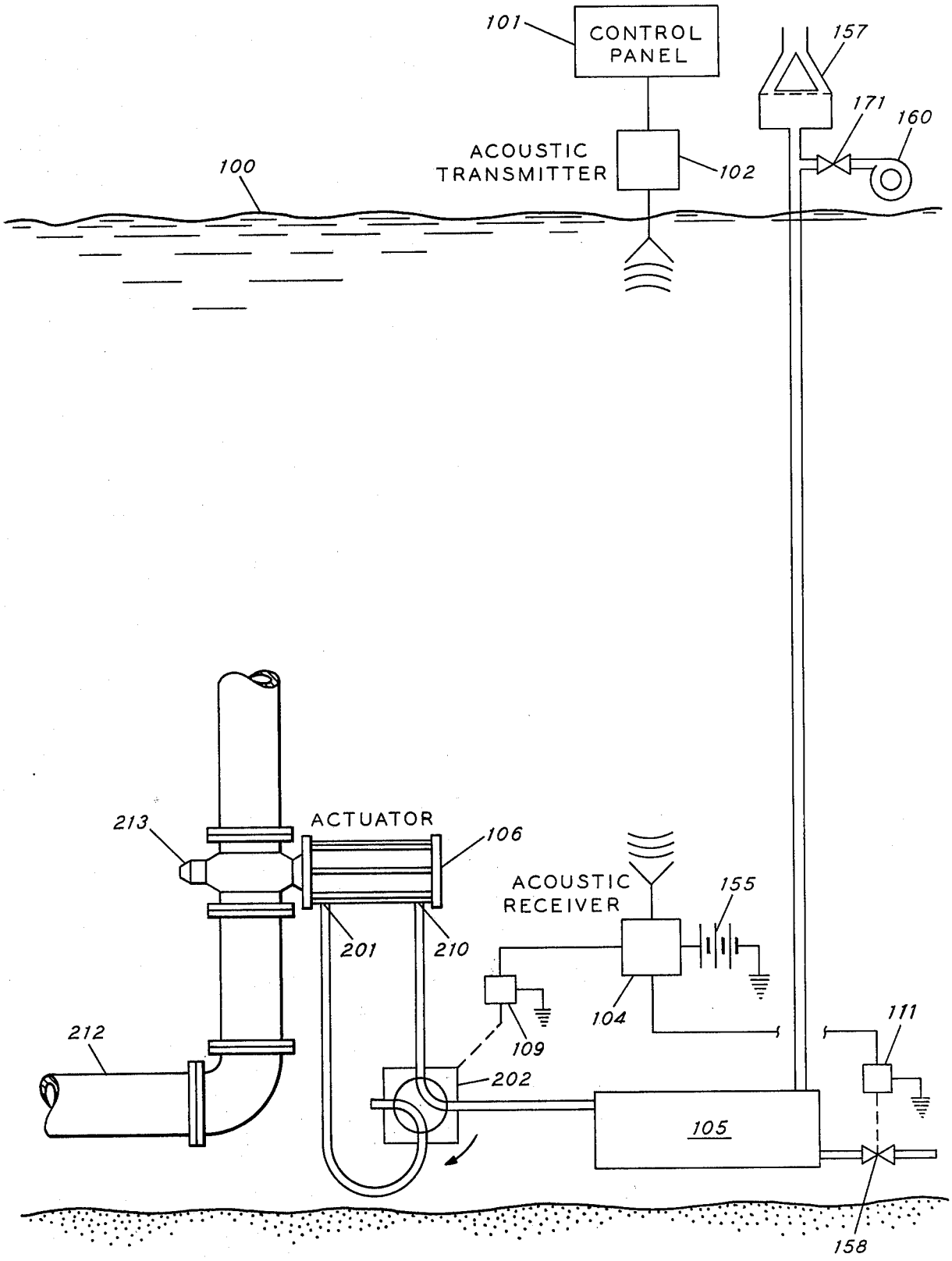
FIG. 10 is a schematic illustration of the present invention used as a primary source of power that actuates a subsea system.

The vent stack 117 may be used to blow out receiver 105 as now described and illustrated in both FIGS. 8 and 10. First, valve 158 is remotely opened by a signal from acoustic transmitter 102 to receiver 104 which sends an electric pulse to relay 111 which operates valve 158. Then air or other gas at a pressure greater than the hydrostatic pressure at valve 158 flows into the stack after opening valve 171 from compressor 160, a source of pressure. This pressure closes check valve 157 and forces the contents or the receiver out into the subsea or into an auxiliary tank (not illustrated).

Figure 9:
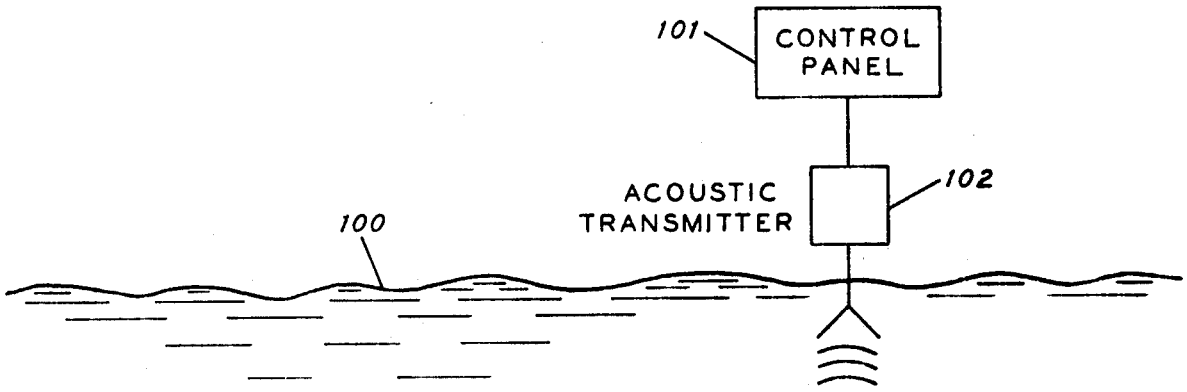
FIG. 9 is a schematic illustration of the present invention with a purging pump and an auxiliary tank to purge the sealed submerged receiver.
Figure 9:
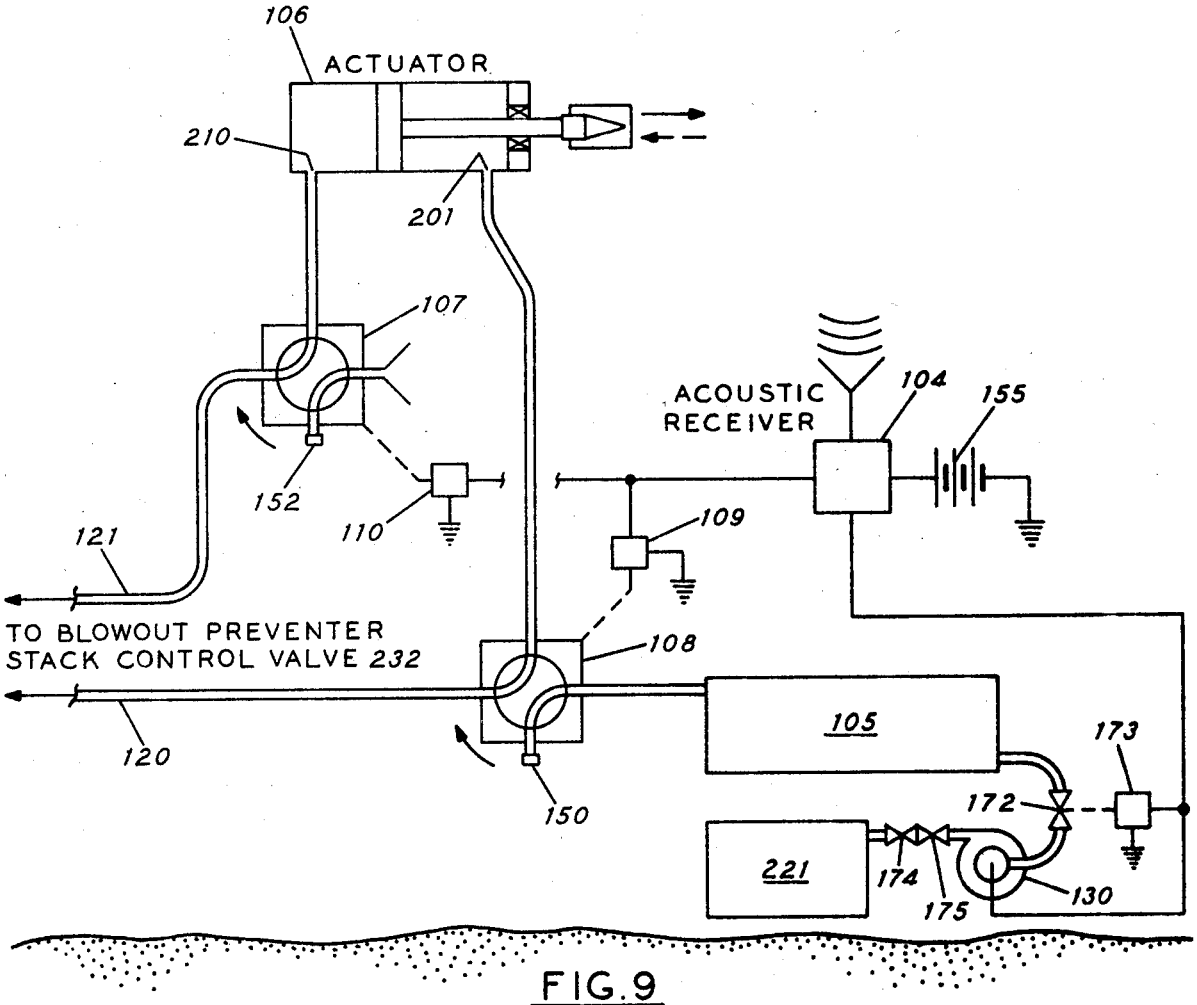

When no vent stack is available, a purging pump 130 may be appropriately connected to tank 105, FIG. 9. The pump removes the exhaust fluid the tank receives when the actuator is operated by the subsea negative energy system. This discharge can be pumped to relocatable auxiliary tank 221 after remotely opening valve 172 through relay 173. Subsequently it can be removed from its subsea location for cleaning without disrupting the fail-safe capability of the system after closing valves 174 and 175.

When this invention is used as the primary source of power, FIG. 10, such as controlling subsea pipeline 212 by valve 213 through actuator 106, several things must be kept in mind. For example, the hydraulic fluid becomes the sea water. The auxiliary tanks, such as tank 221 described above, become redundant because the sea water can obviously be mixed with itself. It also follows that modifications must be made to the valving and control system to accommodate the sea water flowing through them. For example, there is need for only one control valve 202 and relay 109, though two may be arranged as illustrated in FIG. 5. Another point is that concern must be taken regarding quantity and size of receivers such as receiver 105 and associated pumps to empty them once filled from charges of water.

Many other variations will be apparent to those skilled in the art. It is not desired, therefore, to be limited to the specific embodiment shown and described, but only by limitations of the appended claims.

What is claimed is:

1. A system for operating equipment submerged in a body of water, said submerged equipment having intake and discharge sides and said equipment being actuatable by a pressure difference between said intake side and said discharge side, comprising:

submerged means for containing an internal pressure less than the ambient fluid pressure exerted on said submerged equipment;

conduit means connecting said discharge side of said submerged equipment with said submerged means for flowing fluid from said submerged equipment to said submerged means;

normally closed valve means closing said intake side and said discharge side of said submerged equipment, said valve means upon being opened placing said intake side directly in communication with the ambient fluid pressure exerted on said submerged equipment by exposing said intake side to the water at the depth of the location of the equipment while simultaneously placing said discharge side in communication with said submerged means through said conduit means so that the resulting pressure difference between said intake side and said discharge side actuates said submerged equipment.

2. A system for operating submerged equipment in accordance with claim 1 further comprising a vent pipe connected at one end to said submerged means for containing an internal pressure, and the other end of said vent pipe exposed above the surface of said body of water.

3. A system for operating submerged equipment in accordance with claim 1 further comprising:

transmitter means, located at a remote point from said valve means, for initiating a signal to operate said valve means;

means located near said valve means for receiving said signal; and power means for operating said valve means operatively connected to said receiver means so that when a signal is received by said receiver means said power means is triggered to operate said valve means.

4. A system for operating equipment submerged in a body of water having intake and discharge ports, said equipment being actuable by a pressure difference between said intake port and said discharge port, comprising:

submerged means for containing an internal pressure less than the ambient fluid pressure exerted on said submerged equipment;

a valve means for placing said intake port in communication with the ambient fluid pressure exerted on said submerged equipment while simultaneously placing said discharge port in communication with said means for containing an internal pressure less than the ambient fluid pressure exerted on said submerged equipment so that the resulting pressure difference actuates said submerged equipment;

a vent connected at one end to said means for containing an internal pressure, and the other end of said vent exposed above the surface of said body of water;

transmitter means located at a remote point from said valve means for initiating a signal to operate said valve means;

means located near said valve means for receiving said signal;

power means for operating said valve means operatively connected to said receiver means so that when a signal is received by said receiver means said power means is triggered to operate said valve means;

a pressure source connectable to said vent for blowing out said means for containing an internal pressure; and valve means connected to said vessel for allowing fluid to blow out of said vessel.

5. A primary system for operating equipment submerged in a body of fluid, said submerged equipment having discharge and intake ports and being actuable by a pressure difference between said discharge and intake ports, comprising:

a submerged receiver for containing a predetermined internal pressure less than the ambient fluid pressure exerted on said submerged equipment;

conduit means connecting said discharge port of said submerged equipment to said submerged receiver for flowing fluid from said submerged equipment to said submerged receiver;

a first normally closed valve means closing said intake port, said first valve means upon being opened placing said intake port in direct communication with the ambient fluid pressure exerted on said submerged equipment by exposing the intake port to the fluid the equipment is submerged in;

a second normally closed valve means closing said discharge port, said second valve means upon being opened placing said discharge port in communication with said submerged receiver through said conduit means so that the resulting pressure difference is able to actuate said submerged equipment; and said first and said second valve means are interconnected to simultaneously open said intake port of said submerged equipment to ambient fluid pressure, while placing said discharge port of said submerged equipment in communication with said submerged receiver.

6. A primary system for operating submerged equipment of claim 5 wherein said first valve means and said second valve means are located adjacent to said submerged equipment;

means for generating a signal to operate said valve means is at the surface of said body of fluid;

means for receiving said signal is positioned near said subsea equipment; and power means for opening and closing said valves is connected to said receiving means, so that upon reception of a signal said power means operates said first and second valves.

7. A primary system for operating submerged equipment of claim 5 further comprising a vent pipe connected at one end to said submerged receiver and the other end of said vent pipe exposed above the surface of said body of fluid so that the pressure within said receiver is at substantially atmospheric pressure.

8. An auxiliary system for operating a hydraulically actuatable device at a submerged location in a body of water, said device being operatively connected in a hydraulic circuit having an energizing side for conducting hydraulic fluid from a source of pressurized hydraulic fluid to actuate said device and a discharging side for conducting hydraulic fluid away from said device, comprising:

at least one chamber for holding a pressure less than ambient pressure at said submerged location;

means for placing a pressure less than the ambient pressure of said submerged location within said chamber;

first valve means for closing off said energizing side from communication with said source of pressurized hydraulic fluid while simultaneously placing said energizing side of said circuit in direct communication with water at the depth of said submerged location;

second valve means for closing off said discharge of said circuit while simultaneously placing said discharging side of said device in communication with said chamber;

whereby the difference in pressure between the hydrostatic pressure at the depth of said location and pressure of said chamber is made available to actuate and discharge hydraulic fluid of said device into said chamber.

9. An auxiliary system in accordance with claim 8, wherein said first valve means and said second valve means are interconnected to simultaneously open said energizing side of said circuit directly to the ambient water, while placing said discharging side of said device in communication with said chamber.

10. The auxiliary system of claim 8 including a means for purging said chamber of discharged hydraulic fluid, and an auxiliary relocatable tank for receiving said fluid purged from said chamber, and valve means for emptying said auxiliary tank at a later time.

11. An auxiliary system in accordance with claim 8, wherein said first and said second valve means are positioned adjacent to said submerged location, means for initiating a signal to operate said first and second valve means is at the surface of said body of water, means for receiving said signal is located at said subsea location; and power means for opening and closing said first and second valve means is operatively connected to said receiving means so that when a signal is received by said receiving means said power means is triggered to operate said first and second valve means.

12. An auxiliary system in accordance with claim 8, wherein said first and said second valves are constructed and arranged to be actuated by a sonic signal, and means at the surface of said body of water for transmitting through said body of water an appropriate sonic signal to actuate said valves, means for receiving said sonic signal; and power means for opening and closing said valves on signal from said transmitting means connected to said receiver means.

13. An auxiliary system in accordance with claim 8, including a pressure switch to sense pressure losses in said system and to trigger said valves when pressurized hydraulic fluid from said source fails.

14. An auxiliary system in accordance with claim 8, including a pressure amplifier so as to increase the pressure of the hydrostatic pressure at the water depth of said submerged location when said hydrostatic pressure is not sufficient to actuate said device.

15. An auxiliary system in accordance with claim 8, wherein said means for placing the pressure within said chamber is a vent stack connected to said chamber and extending through said body of water to a point above said water surface, and check valve means connected to said vent stack for preventing a fluid from leaving said vent stack.

16. An auxiliary system in accordance with claim 15 further comprising a pressure source connectable to said vent chamber, and remotely actuable valve means for allowing fluid to blow out said chamber.

17. A back-up system for operating and controlling the operation of a well head located adjacent to the water bottom of a body of water, said system operatively connected to a subsea actuator having an energizing side for conducting hydraulic fluid from a source of said fluid to a hydraulically operated apparatus on said well head, and a discharging side for conducting hydraulic fluid back to said source of said fluid, characterized by:

a pressure vessel having a predetermined internal pressure, said vessel located adjacent to said well head, a pair of valves, one of said valves connected respectively to the energizing side and discharging side of said actuator, said pair of valves being constructed and arranged to be actuated from a remote location, wherein the valve connected to the energizing side of said actuator closes communication between said source of hydraulic fluid and said actuator, while simultaneously placing said energizing side of said actuator in direct communication with said body of water, and wherein said valve connected to said discharging side of said actuator closes communication between said source of hydraulic fluid and actuator, while simultaneously placing said discharging side of said actuator in communication with said vessel, so that the difference in pressure between the hydrostatic pressure at the depth of said backup system and the internal pressure of said vessel is made available to operate the actuator.

18. The backup system of claim 17, further characterized by a vent whose lower end is connected to said vessel, the upper end of said vent located above the water surface so as to freely communicate with the atmosphere, a control valve connected to said vent whereby said control valve automatically opens said vent to the atmosphere above said water surface when a primary power source of said subsea system fails; and valve means connected to said vent, said valve means being located in the vicinity of said control valve to prevent a liquid from leaving said vessel when said control valve opens said vent to the atmosphere.

19. The backup system of claim 18 further comprising a pressure source connectable to said vent for blowing out said vessel; and remotely actuable valve means connected to said vessel for allowing fluid to blow out of said vessel.

20. The backup system of claim 19, characterized by a pressure amplifier to increase the operating pressure resulting from the hydrostatic pressure at the water depth of said actuator when said depth does not provide enough of a pressure difference between said hydrostatic pressure and said internal pressure in said submerged vessel to actuate said actuator, a pump connected to said vessel to pump out any hydraulic fluid in said vessel as a result of the operation of said system, and a relocatable auxiliary tank connected to said pump for receiving fluid pumped from said vessel.

21. The backup system of claim 17, characterized by a pressure amplifier to increase the operating pressure resulting from the hydrostatic pressure at the water depth of said actuator when said depth does not provide enough of a pressure difference between said hydrostatic pressure and said internal pressure in said submerged vessel to actuate said actuator; and a pump connected to said vessel to pump out any hydraulic fluid in said vessel as a result of the operation of said system.

22. A backup system for operating a pneumatically actuable device located in an underwater location, said pneumatic actuatable device having an intake side connected to a source of pneumatic power that actuates said device and an exhaust side connected to said source of pneumatic power, comprising:

a vessel in the vicinity of said underwater location; means for placing the interior of said vessel at a predetermined pressure less than the ambient hydrostatic pressure of said vessel;

first means for closing off communication of said intake side with said source of pneumatic power while simultaneously placing said intake side of said device in communication with water at the depth of said device;

second means for closing off communication of the exhaust side of said device with said source of pneumatic power while simultaneously placing said exhaust side of said device in communication with said vessel;

whereby the difference in pressure between the hydrostatic pressure at the depth of said location and the predetermined pressure of said vessel actuates said device.

23. A backup system for operating an electrically powered system submerged in a body of water, comprising:

a tank in the vicinity of said electrically powered system;

means for placing a predetermined pressure in said tank wherein said pressure is less than the hydrostatic pressure surrounding said electrically powered system;

a hydraulic actuator connected to said electrically powered system so that said system is operable by said actuator, wherein said actuator has an energizing side and a discharging side;

normally closed valve means closing said energizing side and said discharging side of said actuator, said valve means upon being opened exposing said energizing side of said actuator to the hydrostatic pressure of said body of water while simultaneously placing said discharging side of said actuator in communication with said tank;

means for communicating said discharging side of said actuator with said tank for flowing water from said actuator to said tank;

whereby the pressure difference between the predetermined pressure of the tank and the hydrostatic pressure surrounding said actuator operates said actuator which in turn operates said electrically powered system as water flows from said body of water through the energizing side and out the discharging side of said actuator and into said tank.

* * * * *